US010268151B2

(12) United States Patent
Takahashi et al.

(10) Patent No.: US 10,268,151 B2
(45) Date of Patent: Apr. 23, 2019

(54) IMAGE FORMING APPARATUS HAVING PHOTOCONDUCTOR AND METHOD OF CONTROLLING THE SAME

(71) Applicant: Brother Kogyo Kabushiki Kaisha, Nagoya-shi, Aichi-ken (JP)

(72) Inventors: Masamitsu Takahashi, Nagoya (JP); Masahito Hamaya, Nagoya (JP); Hiroki Katoh, Tokai (JP); Yudai Minami, Nagoya (JP); Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/918,447

(22) Filed: Mar. 12, 2018

(65) Prior Publication Data

US 2018/0259894 A1 Sep. 13, 2018

(30) Foreign Application Priority Data

Mar. 13, 2017 (JP) ..... 2017-047450

(51) Int. Cl.
*G03G 15/00* (2006.01)
*G03G 15/02* (2006.01)

(52) U.S. Cl.
CPC ..... *G03G 15/553* (2013.01); *G03G 15/0266* (2013.01); *G03G 15/55* (2013.01); *G03G 15/0291* (2013.01); *G03G 2215/027* (2013.01)

(58) Field of Classification Search
CPC ..... G03G 15/553
USPC ..... 399/26
See application file for complete search history.

(56) References Cited

FOREIGN PATENT DOCUMENTS

| | | |
|---|---|---|
| JP | 2010-197969 A | 9/2010 |
| JP | 2016-126049 A | 7/2016 |

*Primary Examiner* — Quana Grainger
(74) *Attorney, Agent, or Firm* — Banner & Witcoff, Ltd.

(57) ABSTRACT

An image forming apparatus, including: a photoconductor configured to be rotatable; a charger configured to charge the photoconductor; an overcurrent detector configured to output an overcurrent detection signal in response to detection of an overcurrent in the charger; and a controller, wherein the controller is configured to execute: an obtaining process of obtaining the overcurrent detection signal output from the overcurrent detector; a first counting process of counting a first number of detections based on the overcurrent detection signal obtained in the obtaining process, the first number of detections being the number of the overcurrent detection signals synchronized with a first cycle corresponding to one rotation of the photoconductor; and a first determining process of determining whether the first number of detections is not smaller than a first threshold which is not smaller than 2.

20 Claims, 9 Drawing Sheets

FIG.6A

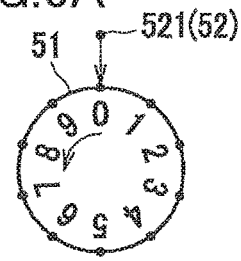

<FIRST MEMORY AREA>

| POSITION | NUMBER OF COUNTS | SET TIME |
|---|---|---|
| $C_0$ | 1 | t0 |

<SECOND MEMORY AREA>

| CURRENT COUNTER | NUMBER OF COUNTS | REFERENCE TIME |
|---|---|---|
| Cd | 1 | td1 |

FIG.6B

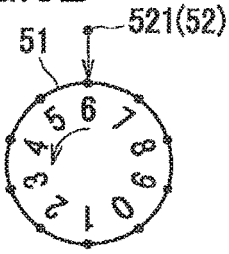

<FIRST MEMORY AREA>

| POSITION | NUMBER OF COUNTS | SET TIME |
|---|---|---|
| $C_0$ | 1 | t0 |
| $C_6$ | 1 | t6 |

<SECOND MEMORY AREA>

| CURRENT COUNTER | NUMBER OF COUNTS | REFERENCE TIME |
|---|---|---|
| Cd | 2 | td2 |

FIG.6C

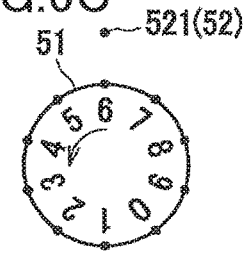

<FIRST MEMORY AREA>

| POSITION | NUMBER OF COUNTS | SET TIME |
|---|---|---|
| $C_0$ | 1 | t0 |
| $C_6$ | 1 | t6 |

<SECOND MEMORY AREA>

| CURRENT COUNTER | NUMBER OF COUNTS | REFERENCE TIME |
|---|---|---|

FIG.6D

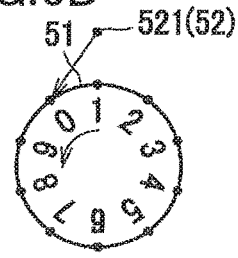

<FIRST MEMORY AREA>

| POSITION | NUMBER OF COUNTS | SET TIME |
|---|---|---|
| $C_0$ | 1 | t0 |
| $C_6$ | 1 | t6 |
| $C_1$ | 1 | t1 |

<SECOND MEMORY AREA>

| CURRENT COUNTER | NUMBER OF COUNTS | REFERENCE TIME |
|---|---|---|
| Cd | 1 | td1 |

FIG.6E

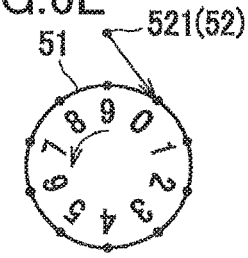

<FIRST MEMORY AREA>

| POSITION | NUMBER OF COUNTS | SET TIME |
|---|---|---|
| $C_0$ | 1 | t0 |
| $C_6$ | 1 | t6 |
| $C_1$ | 1 | t1 |
| $C_9$ | 1 | t9 |

<SECOND MEMORY AREA>

| CURRENT COUNTER | NUMBER OF COUNTS | REFERENCE TIME |
|---|---|---|
| Cd | 1 | td1 |

IMAGE FORMING APPARATUS HAVING PHOTOCONDUCTOR AND METHOD OF CONTROLLING THE SAME

CROSS REFERENCE TO RELATED APPLICATION

The present application claims priority from Japanese Patent Application No. 2017-047450, which was filed on Mar. 13, 2017, the disclosure of which is herein incorporated by reference in its entirety.

BACKGROUND

Technical Field

The following disclosure relates to an image forming apparatus including a charger for charging a photoconductor and also relates to a method of controlling the image forming apparatus.

Description of Related Art

In a charger for charging a photoconductor, an overcurrent flows from the charger to the photoconductor in some cases. Because there is a risk that the photoconductor deteriorates due to the overcurrent, the overcurrent needs to be detected. There has been known an image forming apparatus including a detection circuit for detecting the overcurrent.

SUMMARY

As a method of determining whether the overcurrent is actually generated, there may be considered a method in which it is determined that the overcurrent is generated when the overcurrent is detected by the detection circuit a plurality of times in a relatively short time period, e.g., a time period shorter than that required for one rotation of the photoconductor, in consideration of an influence of noise or the like. The overcurrent may be generated, however, due to another cause. For instance, in some cases, the overcurrent is generated at a specific portion of the photoconductor in synchronism with the rotation of the photoconductor due to local deterioration of the surface of the photoconductor, attachment of foreign matters to a local portion of the photoconductor, or the like. Thus, there may be a risk that the generation of the overcurrent cannot be determined by the method described above.

Accordingly, one aspect of the present disclosure relates to an image forming apparatus capable of determining whether the overcurrent in synchronism with a rotation cycle of the photoconductor is being generated, and also relates to a method of controlling the image forming apparatus.

One aspect of the present disclosure relates to an image forming apparatus, including: a photoconductor configured to be rotatable; a charger configured to charge the photoconductor; an overcurrent detector configured to output an overcurrent detection signal in response to detection of an overcurrent in the charger; and a controller, wherein the controller is configured to execute: an obtaining process of obtaining the overcurrent detection signal output from the overcurrent detector; a first counting process of counting a first number of detections based on the overcurrent detection signal obtained in the obtaining process, the first number of detections being the number of the overcurrent detection signals synchronized with a first cycle corresponding to one rotation of the photoconductor; and a first determining process of determining whether the first number of detections is not smaller than a first threshold which is not smaller than 2.

Another aspect of the present disclosure relates to a method of controlling an image forming apparatus including: a photoconductor configured to be rotatable; a charger configured to charge the photoconductor; and a detector configured to detect a current in the charger, including: an obtaining step of obtaining an overcurrent detection signal in response to a signal output from the detector; a counting step of counting a first number of detections based on the overcurrent detection signal obtained in the obtaining step, the first number of detections being the number of the overcurrent detection signals synchronized with a first cycle corresponding to one rotation of the photoconductor; and a determining step of determining whether the first number of detections is not smaller than a first threshold which is not smaller than 2.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which:

FIG. 6A is a view showing one example of an operation of a controller;

FIG. 6B is a view showing one example of the operation of the controller;

FIG. 6C is a view showing one example of the operation of the controller;

FIG. 6D is a view showing one example of the operation of the controller;

FIG. 6E is a view showing one example of the operation of the controller;

DETAILED DESCRIPTION OF THE EMBODIMENT

Figure 1:
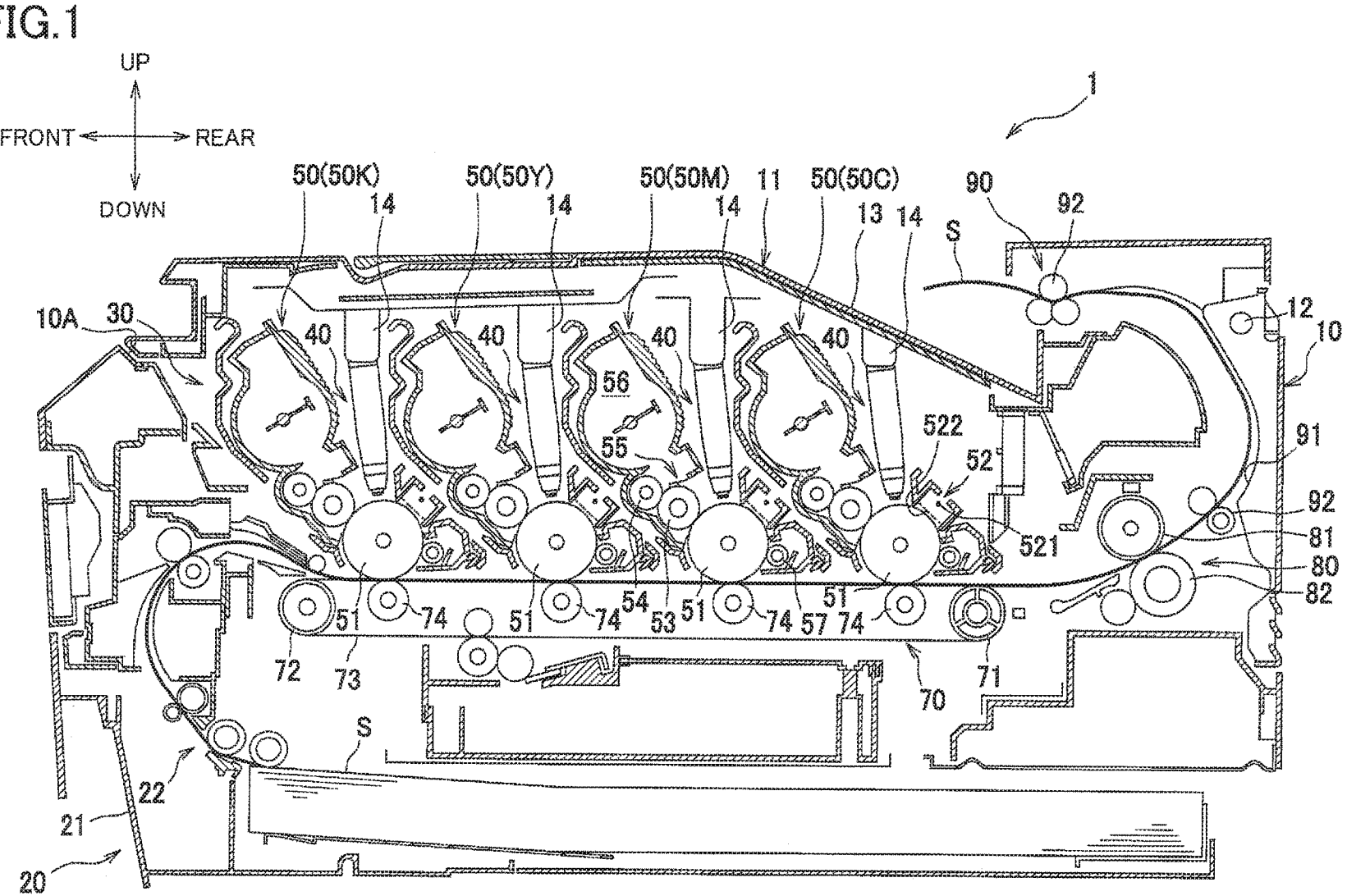
FIG. 1 is a cross-sectional view of a color printer according to one embodiment.

Referring to the drawings, there will be explained in detail one embodiment according to the present disclosure. In the following explanation, an overall structure of a color printer 1 as one example of an image forming apparatus is first explained, and features of the present disclosure are thereafter explained.

In the following explanation, directions are defined based on directions indicated in FIG. 1. That is, a left side and a right side in FIG. 1 are respectively defined as a front side and a rear side, and a front side and a back side of the sheet of FIG. 1 are respectively defined as a right side and a left side. Further, an up-down direction in FIG. 1 is defined as an up-down direction.

As shown in FIG. 1, the color printer 1 includes a printer housing 10, an upper cover 11, a sheet supplier 20 configured to supply a sheet S, an image forming portion 30 configured to form an image on the supplied sheet S, and a sheet discharger 90 configured to discharge the sheet S on which the image is formed.

The upper cover 11 is provided on an upper portion of the printer housing 10. The upper cover 11 pivots about a pivot shaft 12 located at a rear portion of the printer housing 10 such that a front portion of the upper cover 11 moves upward and downward with respect to the printer housing 10. Thus, the upper cover 11 opens and closes an opening 10A formed in an upper surface of the printer housing 10.

The sheet supplier 20 includes: a sheet-supply tray 21 provided in a lower portion of the printer housing 10 and storing the sheets S; and a sheet supplying mechanism 22 configured to supply the sheets S from the sheet-supply tray 21 to the image forming portion 30. The sheets S in the sheet-supply tray 21 are separated one by one by the sheet supplying mechanism 22 and supplied to the image forming portion 30.

The image forming portion 30 includes four LED units 40, four process units 50, a transfer unit 70, and a fixing unit 80.

Each LED unit 40 is pivotably supported by the upper cover 11 via a corresponding one of holders 14 and disposed above a corresponding one of photoconductors 51 in a state in which the upper cover 11 is closed. The LED unit 40 exposes a surface of the electrically charged photoconductor 51 by blinking of a light emitter (LED) provided at a distal end of the LED unit 40, based on image data.

The process units 50 are arranged in parallel in the front-rear direction between the upper cover 11 and the sheet-supply tray 21. The process units 50 are mountable on and removable from the printer housing 10 substantially in the up-down direction through the opening 10A of the printer housing 10 which is exposed when the upper cover 11 is opened.

Each process unit 50 includes the photoconductor 51, a charger 52 of scorotron type as one example of a charger, a developing roller 53, a supply roller 54, a layer-thickness limiting blade 55, a toner storage 56 storing toner, and a cleaning roller 57.

The four process units 50 are process units 50K, 50Y, 50M, 50C respectively containing black toner, yellow toner, magenta toner, and cyan toner and are arranged in this order from an upstream side in a conveyance direction of the sheet S. When referring to the photoconductor 51 and the charger 52 corresponding to the toner of a particular color in the specification and the drawings, a corresponding one of signs K, Y, M, C respectively indicating black, yellow, magenta, and cyan is attached.

Each photoconductor 51 includes a cylindrical drum body having electrical conductivity and a photoconductive layer formed on an outer circumferential surface of the drum body. The photoconductor 51 is rotatable with respect to the printer housing 10.

The chargers 52 are provided so as to correspond to the respective photoconductors 51. Each charger 52 includes a wire 521 and a grid electrode 522. The charger 52 is configured to generate a corona discharge by application of a wire voltage to the wire 521, so as to expose the surface of the corresponding photoconductor 51.

The developing rollers 53 are provided so as to correspond to the respective photoconductors 51. Each developing roller 53 bears toner on its surface.

The cleaning rollers 57 are provided so as to correspond to the respective photoconductors 51. Each cleaning roller 57 contacts the corresponding photoconductor 51 so as to remove foreign matters (such as paper dust and toner) from the surface of the photoconductor 51.

The transfer unit 70 is provided between the sheet-supply tray 21 and the process unit 50. The transfer unit 70 includes a drive roller 71, a driven roller 72, an endless conveyor belt 73 looped over the drive roller 71 and the driven roller 72, four transfer rollers 74. An outer surface of the conveyor belt 73 is in contact with the photoconductors 51, and the transfer rollers 74 are disposed inside the loop of the conveyor belt such that the conveyor belt 73 is nipped by and between the transfer rollers 74 and the photoconductors 51.

The fixing unit 80 is provided behind the process units 50 and the transfer unit 70. The fixing unit 80 includes a heating roller 81 and a pressure roller 82 disposed opposite to the heating roller 81 for pressing the heating roller 81.

In the image forming portion 30, the surface of the photoconductor 51 is electrically charged uniformly by the charger 52 and exposed by the LED unit 40, so that an electrostatic latent image based on image data is formed on the photoconductor 51.

The toner in the toner storage 56 is supplied to the developing roller 53 via the supply roller 54 and then enters between the developing roller 53 and the layer-thickness limiting blade 55, so as to be borne on the developing roller 53 as a thin layer having a constant thickness.

The toner borne on the developing roller 53 is supplied to the exposed portion of the photoconductor 51, so that the electrostatic latent image is formed into a visible image. Thus, a toner image is formed on the photoconductor 51. Thereafter, the sheet S supplied from the sheet supplier 20 is conveyed between the photoconductors 51 and the conveyor belt 73 (the transfer rollers 74), so that the toner images formed on the photoconductors 51 are transferred to the sheet S. The sheet S on which the toner images are transferred is conveyed between the heating roller 81 and the pressure roller 82, so that the toner images are thermally fixed.

The sheet discharger 90 includes a sheet-discharge path 91 for guiding the sheet S conveyed from the fixing unit 80 and a plurality of conveying rollers 92 for conveying the sheet S. The sheet S on which the toner images are thermally fixed is conveyed by the conveying rollers 92 through the sheet-discharge path 91, discharged outside the printer housing 10, and placed on the sheet-discharge tray 13.

Figure 2:
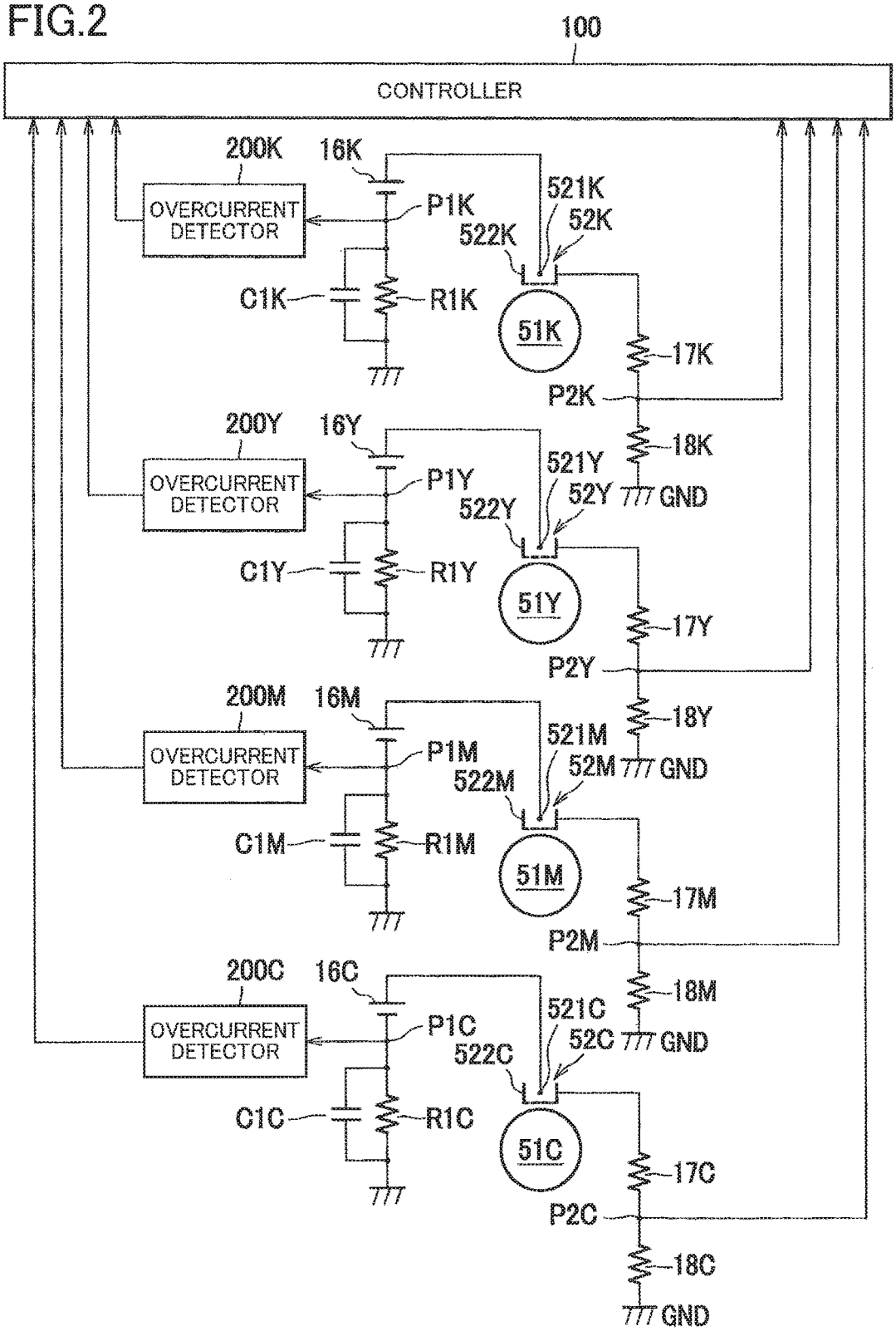
FIG. 2 is a view showing a circuit configuration around chargers.

As shown in FIG. 2, the color printer 1 includes a controller 100 and overcurrent detectors 200.

A high voltage power source 16 is connected to the wire 52 of each charger 52. The high voltage power source 16 is a circuit for applying a high wire voltage to the wire 521. For convenience sake, an illustration of the high voltage power source 16 is simplified in FIG. 2. The high voltage power source 16 is grounded via a resistor R1. A capacitor C1 is connected to the resistor R1 in parallel.

The overcurrent detectors 200 are provided for the respective chargers 52. The overcurrent detector 200 is connected to: a first connection point P1 of a wire connecting the high voltage power source 16 and the resistor R1; and the controller 100. Each overcurrent detector 200 is configured to detect generation of an overcurrent in the corresponding charger 52.

The application of a high wire voltage to the wire 521 causes a corona discharge to be generated between the wire 521 and the grid electrode 522, whereby the photoconductor 51 is electrically charged. The electric potential of the photoconductor 51 is determined by the electric potential of the grid electrode 522. When the corona discharge is generated, a current flows in the grid electrode 522. (This current will be hereinafter referred to as "grid current" where appropriate.)

The grid electrode 522 of each charger 52 is grounded via a first resistor 17 and a second resistor 18 connected in series. The electric potential of the grid electrode 522 is determined by the grid current and resistance values of the first resistor 17 and the second resistor 18.

The controller 100 and a wire connecting the first resistor 17 and the second resistor 18 are connected at a second connection point P2. The controller 100 detects the grid currents flowing in the respective grid electrodes 522K, 522Y, 522M, 522C from the potentials at the respective second connection points P2.

Figure 3:
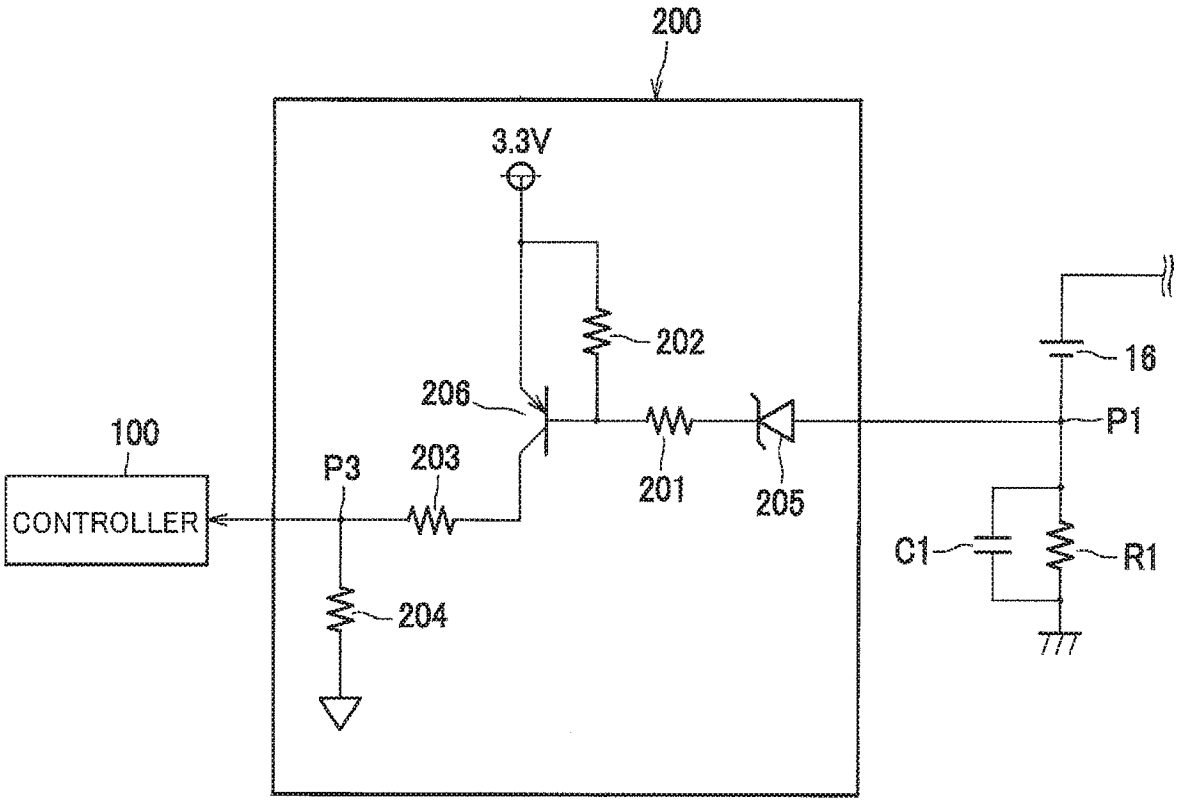
FIG. 3 is a view showing a configuration of an overcurrent detector.

As shown in FIG. 3, the overcurrent detector 200 is a current detecting circuit which includes a plurality of resistors 201-204, a Zener diode 205, and a transistor 206.

A third connection point P3 is provided between the resistor 203 and the resistor 204. The third connection point P3 is connected to the controller 100. In the case where a base current does not flow in a base of the transistor 206 and a non-conductive state is established between an emitter and a collector of the transistor 206, the electric potential of the third connection point P3 becomes close to 0V by the resistor 204 which is a pull down resistor. Thus, the output of the overcurrent detector 200 is in a low state.

In the case where an abnormal discharge is generated in the charger 52, an overcurrent flows in the charger 52 due to the abnormal discharge, and a voltage corresponding to the overcurrent is generated at the first connection point P1. The voltage generated at the first connection point P1 is applied to an anode of the Zener diode 205. When the voltage exceeds a Zener voltage, the base current flows via the resistor 201 which is a base resistor of the transistor 206. In the case where the base current flows in the transistor 206 and a conductive state is established between the collector and the emitter, the electric potential of the third connection point P3 becomes equal to 3.3 V that is substantially equal to the power source voltage. Thus, the output of the overcurrent detector 200 is in a high state. In the following explanation, an output signal in the high state will be referred to as an overcurrent detection signal, and an output signal in the low state will be referred to as a normal signal.

The controller 100 includes a CPU, a RAM, a ROM, a nonvolatile memory, an ASIC, and an input/output circuit. The controller 100 executes control by executing various arithmetic processing based on a print command output from an external computer, signals output from the second connection points P2 and the overcurrent detectors 200, and programs and data stored in the ROM, for instance. The controller 100 is configured to execute an obtaining process, a first counting process, a first determining process, a second counting process, a second determining process, and a notifying process. In other words, the controller 100 operates based on the programs so as to function as a means to execute the processes described above. Further, a controlling method by the controller 100 includes steps of executing the processes. In the processes described above, the controller 100 causes the photoconductors 51 and so on to rotate.

The obtaining process is a process of obtaining an overcurrent detection signal output from the overcurrent detector 200. Specifically, in the obtaining process, the controller 100 detects a signal (the overcurrent detection signal or the normal signal) output from the overcurrent detector 200 on a particular sampling cycle Ts. Here, the sampling cycle Ts is a cycle shorter than a first cycle T1 (which will be described) corresponding to one rotation of the photoconductor 51. In the present embodiment, the sampling cycle Ts is set to 1/10 of the first cycle T1. The sampling cycle Ts is not limited to the particular cycle, that is, the sampling cycle Ts may be a cycle of any length as long as the length of the cycle is shorter than the first cycle T1.

The first counting process is a process of counting the number of detections of an abnormal discharge generated on the first cycle T1 corresponding to one rotation of the photoconductor 51, based on the overcurrent detection signal obtained in the obtaining process. For instance, the first cycle T1 may be the same as a time T2 required for the photoconductor 51 to make one rotation. In the present embodiment, a range $\alpha$ is allowed for the time T2 required for the photoconductor 51 to make one rotation, and the first cycle T1 is accordingly set to a period T2$\pm\alpha$. The range $\alpha$ is allowed for the time T2 for the following reasons.

In the case where the photoconductive layer of the photoconductor 51 suffers from a flaw or a scratch at a specific portion and the drum body is exposed, for instance, the abnormal discharge may be generated from the charger 52 when the specific portion is opposed to the charger 52. Examples of the abnormal discharge include a spark discharge between the wire 521 and the grid electrode 522 or the photoconductor 51. The abnormal discharge that arises from the flaw of the photoconductor 51 is a cyclic abnormal discharge generated every time the specific portion reaches a predetermined position at which the specific portion is opposed to the wire 521 of the charger 52 in the diametrical direction of the photoconductor 51, namely, every time the photoconductor 51 makes one rotation. Such cyclic abnormal discharge is generated not only when the specific portion is located at the predetermined position (at which the specific portion is opposed to the wire 521) but also when the specific portion is located near the predetermined position, namely, located at a position shifted from the predetermined position upstream or downstream in the rotational direction of the photoconductor 51. In view of this, the first cycle T1 is set to T2$\pm\alpha$, (T1=T2$\pm\alpha$) in the present embodiment.

In the first counting process, the controller 100 sets a cyclic current counter $C_X$ corresponding to a specific portion of the photoconductor 51 at which the overcurrent due to the abnormal discharge is generated, and increments the cyclic current counter $C_X$. A manner of setting the cyclic current counter $C_X$ will be later explained. The controller 100 sets the cyclic current counters $C_X$ for various portions of the photoconductor 51 and performs counting by each cyclic current counter $C_X$, so as to count the number of detections of the overcurrent generated on the first cycle T1 including the range $\alpha$. Specifically, the controller 100 adds up the number of counts of the cyclic current counter $C_X$ corresponding to the specific portion, the number of counts of a cyclic current counter $C_{X-1}$ corresponding to a portion located downstream of the specific portion, and the number of counts of a cyclic current counter $C_{X+1}$ corresponding to a portion located upstream of the specific portion. Thus, the controller 100 counts the number of detections (the number of times of detections) of the overcurrent generated on the first cycle T1. In the following explanation, the number of detections of the overcurrent generated on the first cycle T1 will be referred to as a first number of detections where appropriate.

The first determining process is a process of determining whether the first number of detections counted in the first counting process is not smaller than a first threshold N1 which is not smaller than 2. Here, the first number of detections is $C_X+C_{X-1}+C_{X+1}$ as described above. In other words, the first number of detections is the number of the overcurrent detection signals synchronized with the first cycle T1. Specifically, in the case where a plurality of cyclic current counters $C_X$ are already set, the controller 100 executes the first determining process for each of the cyclic current counters $C_X$. In the case where cyclic current counters $C_0$, $C_6$ corresponding to the numbers "0, 6" are already set, for instance, the controller 100 compares $C_0+C_9+C_1$ with the first threshold N1 and compares $C_6+C_5+C_7$ with the first threshold N1. In the case where the cyclic current counters $C_{X-1}$, $C_{X+1}$ are not set, the controller 100 determines the number of counts of each cyclic current counter $C_{X-1}$, $C_{X+1}$ to be equal to 0 and adds 0 to the number of counts of the cyclic current counter $C_X$.

While the first threshold N1 may be determined by experiments, simulations or the like, the first threshold N1 may be determined so as to satisfy the following expression (1), for instance:

$$M>N1>M/2 \quad (1)$$

M: the maximum number of rotations of the photoconductor 51 in a period from a start timing of the first counting process for the specific portion of the photoconductor 51 to an end timing of the first counting process for the specific portion.

In the present embodiment, the start timing of the first counting process corresponds to a time point of setting the cyclic current counter $C_X$, and the end timing of the first counting process corresponds to a time point of deleting the cyclic current counter $C_X$. That is, the start timing of the first counting process is a time point when the controller 100 has first detected the overcurrent detection signal and a time point when the cyclic current counter $C_X$ is set. That is, the start timing of the first counting process is a time point of detection of the overcurrent detection signal in a state in which the cyclic current counter $C_X$ is not set. The end timing of the first counting process is a time point when the condition for resetting the number of counts of the cyclic current counter $C_X$ is satisfied in a state in which the cyclic current counter $C_X$ is set and a time point when the cyclic current counter $C_X$ is deleted. The maximum number of rotations M and the first threshold N1 may be determined by experiments, simulations or the like. In the present embodiment, the maximum number of rotations M is 5 (M=5), and the first threshold N1 is 3 (N1=3). That is, in the first determining process, it is determined whether the overcurrent generated on the first cycle T1 is detected three times within a period in which the photoconductor 51 makes five rotations.

The second counting process is a process of counting a second number of detections which is the number of detections of an overcurrent generated in a period T3 shorter than the first cycle T1, based on the overcurrent detection signal obtained in the obtaining process. Specifically, in the second counting process, the controller 100 sets a current counter Cd for counting the second number of detections and increments the current counter Cd. A manner of setting the current counter Cd will be later explained.

The second determining process is a process of determining whether the second number of detections counted in the second counting process is not smaller than a second threshold N2 which is not smaller than 2. The second threshold N2 may be determined by experiments, simulations or the like. In the present embodiment, the second threshold N2 is set to 3 (N2=3). That is, in the second determining process, it is determined whether the overcurrent generated in the period T3 shorter than the first cycle T1 is detected successively three times without a time interval corresponding to the time required for one rotation of the photoconductor 51.

The notifying process is a process executed when it is determined in the first determining process that the first number of detections is not smaller than the first threshold N1 or when it is determined in the second determining process that the second number of detections is not smaller than the second threshold N2. In the notifying process, the controller 100 notifies information indicative of abnormality by a notifying device. The notifying device may be a display panel, a lamp, a buzzer or the like of the color printer 1 or an external device, such as a computer, wirelessly connected or wired to the color printer 1.

For instance, the information indicative of abnormality may be an instruction for instructing cleaning of the wire 521 or an instruction for instructing replacement of the photoconductor 51. Further, in the notifying process, the controller 100 may cancel a printing control or may decrease the voltage applied to the wire 521 of the charger 52.

Figure 4:
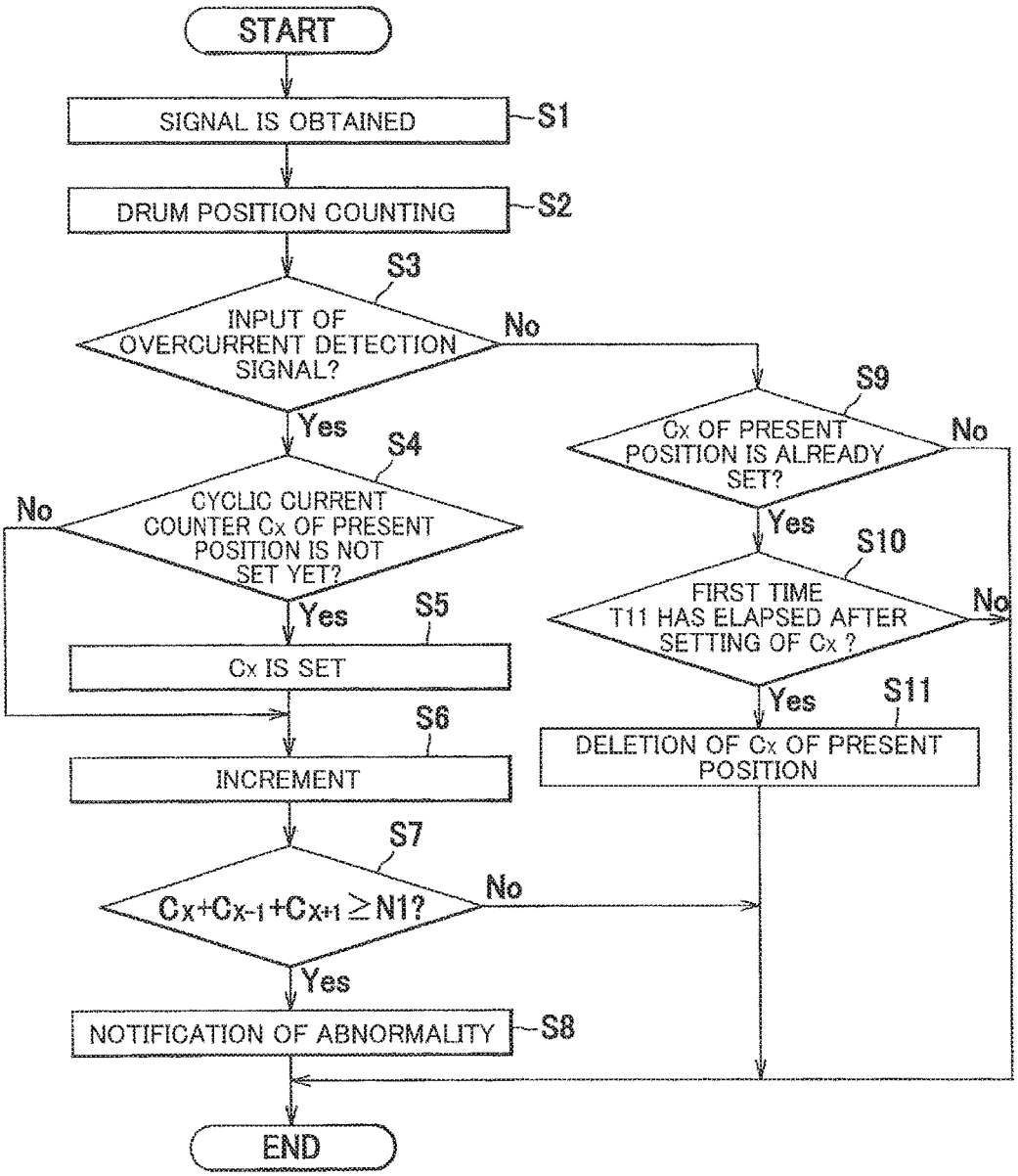
FIG. 4 is a flowchart showing a long-cycle abnormality determining process.
Figure 5:
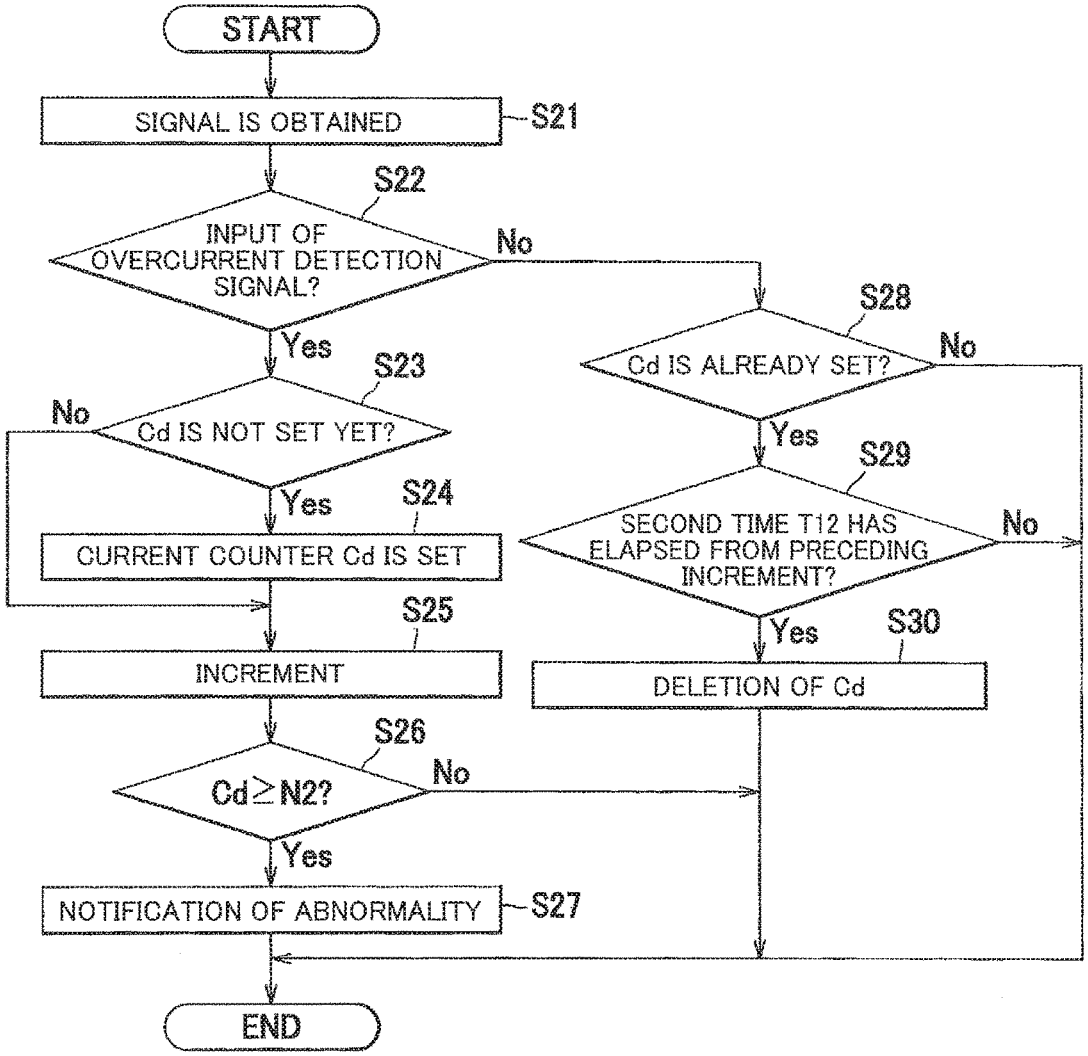
FIG. 5 is a flowchart showing a short-period abnormality determining process.

There will be next explained in detail an operation of the controller 100. The controller 100 repeatedly executes processes shown in FIGS. 4 and 5 during execution of a printing control for forming an image on the sheet S. The process of FIG. 4 is a long-cycle abnormality determining process of determining the overcurrent due to cyclic abnormal discharge as abnormality. The process of FIG. 5 is a short-period abnormality determining process of determining the overcurrent generated in the period T3 shorter than the first cycle T1 due to short-period abnormal discharge as abnormality. The controller 100 executes the processes of FIGS. 4 and 5 for the respective colors.

As shown in FIG. 4, in the long-cycle abnormality determining process, the controller 100 obtains one of the overcurrent detection signal and the normal signal from the overcurrent detector 200 (S1). After Step S1, the controller 100 performs drum position counting for assigning optional numbers "0-9" to respective positions on the surface of the photoconductor 51 (S2). Specifically, at Step S2, the controller 100 assigns any one of the numbers "0-9" to the signal obtained at Step S1. More specifically, in the first execution of the process of Step S2, the controller 100 assigns "0" to the signal obtained at Step S1 for the first time. In the second execution of the process of Step S2, the controller 100 assigns "1" to the signal obtained at Step S1 for the second time. Similarly, in the third and subsequent executions of the process of Step S2, the controller 100 sequentially assigns the numbers 3→4→5→6→7→8→9→0→ . . . in this order to the signals obtained at S1 for the third and subsequent times. Thus, the numbers "0-9" are assigned to the respective positions on the surface of the photoconductor 51, as shown in FIG. 6A, and it is possible to recognize the generation state of the abnormal discharge at each position.

In the present embodiment, because the sampling cycle Ts is set to 1/10 of the first cycle T1 as described above, the numbers to be assigned are "0-9". The present disclosure is not limited to this configuration. In the case where the sampling cycle Ts, namely, a control cycle, is set to 1/20 of the first cycle T1, the numbers to be assigned are "0-19".

After Step S2, the controller 100 determines whether the overcurrent detection signal is input, namely, whether the signal obtained at Step S1 is the overcurrent detection signal (S3). When it is determined at Step S3 that the overcurrent detection signal is input (Yes), the controller 100 determines whether the cyclic current counter $C_X$ corresponding to the present or current position is not set yet (S4).

When it is determined at Step S4 that the cyclic current counter $C_X$ is not set yet (Yes), the controller 100 sets the cyclic current counter $C_X$ of the present position (S5). Specifically, in the case where the number "0" is assigned at Step S2, for instance, the controller 100 sets a cyclic current counter $C_0$ corresponding to the position of the number "0".

Here, the setting of the cyclic current counter $C_X$ is conducted such that the cyclic current counter $C_X$ is written in an available storage area in the memory. In the following explanation, the storage area in which the cyclic current counter $C_X$ is written will be referred to as a first memory area where appropriate. When the cyclic current counter $C_X$ of the present position is set at Step S5, the controller 100 stores, in the first memory area, a set time tx which is a time of setting the cyclic current counter $C_X$, in association with the cyclic current counter $C_X$.

After Step S5 or when it is determined at Step S4 that the cyclic current counter $C_X$ is already set (No), the controller 100 increments the cyclic current counter $C_X$ (S6). After Step S6, the controller 100 determines whether the first number of detections, namely, $C_X+C_{X-1}+C_{X+1}$, is not smaller than the first threshold N1 (S7).

When it is determined at Step S7 that the first number of detections is not smaller than the first threshold N1 (Yes), the controller 100 executes the notifying process so as to notify abnormality (S8). Further, the controller 100 deletes the cyclic current counter $C_X$ at Step S8. When it is determined at Step S7 that the first number of detections is smaller than the first threshold N1 (No), the controller 100 ends the present process.

When it is determined at Step S3 that the overcurrent detection signal is not input (No), the controller 100 determines whether the cyclic current counter $C_X$ of the present position is already set (S9). When it is determined at Step S9 that the cyclic current counter $C_X$ of the present position is already set (Yes), the controller 100 determines whether a first time T11 has elapsed from the set time tx of the cyclic current counter $C_X$ of the present position (S10). Here, the first time T11 is set to a time required for the photoconductor 51 to make "M" times of rotations, for instance. It is noted that "M" is equal to the value of "M" in the expression (1) described above.

When it is determined at Step S10 that the first time T11 has elapsed from the set time tx (Yes), the controller 100 deletes the cyclic current counter $C_X$ of the present position from the first memory area (S11) and ends the present process. When a negative decision (NO) is made at Step S9 or Step S10, the controller 100 ends the present process without deleting the cyclic current counter $C_X$ of the present position.

As shown in FIG. 5, in the short-period abnormality determining process, the controller 100 obtains one of the overcurrent detection signal and the normal signal from the overcurrent detector 200 (S21). After Step S21, the controller 100 determines whether the overcurrent detection signal is input, namely, whether the signal obtained at Step S1 is the overcurrent detection signal (S22).

When it is determined at Step S22 that the overcurrent detection signal is input (Yes), the controller 100 determines whether the current counter Cd is not set yet (S23). When it is determined at Step S23 that the current counter Cd is not set yet (Yes), the controller 100 sets the current counter Cd (S24).

The setting of the current counter Cd is conducted such that the current counter Cd is written in an available storage area in the memory. In the following explanation, the storage area in which the current counter Cd is written will be referred to as a second memory area where appropriate.

After Step S24 or when it is determined at Step S23 that the current counter Cd is already set (No), the controller 100 increments the current counter Cd (S25). In the case where the current counter Cd is incremented at Step S25, the controller 100 stores, in the second memory area, a time of increment of the current counter Cd as a reference time tdx in association with the current counter Cd. Specifically, when the current counter Cd is incremented from 0 to 1, the controller 100 stores the time of increment as a reference time td1 in the second memory area. When the current counter Cd is incremented from 1 to 2, the controller 100 stores the time of increment as a reference time td2 in the second memory area.

After Step S25, the controller 100 determines whether the second number of detections, namely, the current counter Cd, is not smaller than the second threshold N2 (S26). When it is determined at Step S26 that the second number of detections is not smaller than the second threshold N2 (Yes), the controller 100 executes the notifying process so as to notify abnormality (S27). Further, the controller 100 deletes the current counter Cd at Step S27. When it is determined at Step S26 that the second number of detections is smaller than the second threshold N2 (No), the controller 100 ends the processing.

When it is determined at Step S22 that the overcurrent detection signal is not input (No), the controller 100 determines whether the current counter Cd is already set (S28). When it is determined at Step S28 that the current counter Cd is already set (Yes), the controller 100 determines whether a second time T12 has elapsed from the time of preceding increment of the current counter Cd, namely, from the reference time tdx (S29).

Here, the second time T12 is set to a time not longer than the time T2 required for the photoconductor 51 to make one rotation, for instance. In the present embodiment, the second time T12 is set to the time T2. That is, at Step S29, it is determined whether the photoconductor 51 has made one rotation after a time point of generation of the abnormal discharge.

When it is determined at Step S29 that the second time T12 has elapsed from the reference time tdx (Yes), the controller 100 deletes the current counter Cd from the second memory area (S30) and ends the present process. In the case where a negative decision (NO) is made at Step S28 or S29, the controller 100 ends the present process without deleting the current counter Cd.

Referring next to FIGS. 6A-6E, there will be explained one example of the control of the controller 100. It is noted that the controller 100 repeatedly executes the processes shown in FIGS. 4 and 5 when the printing control is started.

In the case where the abnormal discharge is never generated from the charger 52 during execution of the printing control, the controller 100 repeatedly executes the processes of Steps S1-S3, S9 (S9:No) of FIG. 4, and the controller 100 assigns the numbers "0-9" to the respective positions on the surface of the photoconductor 51 (See FIG. 6A, etc.)

As shown in FIG. 6A, in the case where the abnormal discharge is generated from the charger 52 when the portion on the surface of the photoconductor 51 to which the number "0" is assigned is being opposed to the wire 521, the controller 100 sequentially executes the processes of Steps S1-S6 of FIG. 4, so as to store, in the first memory area, the cyclic current counter $C_0$ corresponding to the present position "0". Specifically, the controller 100 stores the cyclic current counter $C_0$ the number of counts of which is 1 and a set time t0 of the cyclic current counter $C_0$. Further, the controller 100 sequentially executes the processes of Steps S21-S25 of FIG. 5, so as to store, in the second memory area, the current counter Cd the number of counts of which is 1 and the reference time td1 which is the time when the number of counts is incremented from 0 to 1.

As shown in FIG. 6B, in the case where a second abnormal discharge is generated before the photoconductor 51 makes one rotation after the first abnormal discharge has been generated, specifically, in the case where the second abnormal discharge is generated when a portion to which the number "6" is assigned is being opposed to the wire 521, the controller 100 stores, in the first memory area, the cyclic current counter $C_6$ corresponding to the present position "6" together with the number of counts "1" and the set time t6. Further, the controller 100 increments the current counter Cd from 1 to 2 and overwrites the second memory area with the number of counts "2" of the current counter Cd and the reference time td2 which is the time when the current counter Cd is incremented this time.

As shown in FIG. 6C, in the case where no abnormal discharge is generated within a period from the time point of generation of the second abnormal discharge to a time point when the photoconductor 51 makes one rotation, the controller 100 makes an affirmative decision (YES) at Step S29 of FIG. 5 and deletes the current counter Cd. In the case where the abnormal discharge is generated within a period from the state of FIG. 6B to the time point when the photoconductor 51 makes one rotation, the controller 100 sequentially executes the processes of Steps S22-S27 of FIG. 5 so as to notify abnormality.

As shown in FIG. 6D, in the case where a third abnormal discharge is generated at the portion to which the number "0" is assigned (the "0" assigned position) when the "0" assigned portion has passed, by a slight distance, the predetermined position (opposed to the wire 521) before the photoconductor 51 makes one rotation from the state of FIG. 6C, the controller 100 stores, in the first memory area, the cyclic current counter $C_1$ corresponding to the present position "1" together with the number of counts "1" and the set time t1. Further, the controller 100 newly sets the current counter Cd and stores, in the second memory area, the current counter Cd, together with the number of counts "1" and the reference time td1.

As shown in FIG. 6E, before the photoconductor 51 makes one rotation thereafter, in the case where a fourth abnormal discharge is generated at the portion to which the number "0" is assigned (the "0" assigned position) when the "0" assigned position is located slightly upstream of the predetermined position (opposed to the wire 521) in the rotational direction of the photoconductor 51, the controller 100 stores, in the first memory area, the cyclic current counter $C_9$ corresponding to the present position "9", together with the number of counts "1" and the set time t9. As a result, a sum of the number of counts of the cyclic current counters $C_9$-$C_1$ corresponding to the three adjacent portions of the photoconductor 51, namely, corresponding to the portions of the photoconductor 51 to which the numbers "9-1" are assigned, becomes equal to 3. Accordingly, the controller 100 makes an affirmative decision (Yes) at Step S7 of FIG. 4 and notifies abnormality.

The present embodiment offers the following advantageous effects.

By determining whether the number of detections of the abnormal discharge generated on the first cycle T1 corresponding to one rotation of the photoconductor 51 is not smaller than the first threshold N1, it is possible to determine whether the cyclic abnormal discharge in synchronism with the rotation cycle of the photoconductor 51, such as the abnormal discharge arising from the flaw or scratch on the surface of the photoconductor 51, is being generated.

By determining whether the number of detections of the abnormal discharge generated at intervals shorter than the first cycle T1 is not smaller than the second threshold N2, it is possible to determine whether the abnormal discharge arising from the charger 52 is being generated.

The maximum number of rotations M of the photoconductor 51 in the period from the start timing of the first counting process to the end timing of the first counting process is set so as to satisfy the expression (1) described above. This configuration enables the determination as to whether the abnormal discharge is being generated even when the long-cycle abnormal discharge arising from the flaw of the photoconductor 51 or the like is intermittently generated. Further, the lower limit value of the first threshold N1 is set to M/2, so that it is possible to determine that the abnormal discharge is being generated cyclically with a high probability, namely, a probability higher than ½.

In the case where it is determined in the first determining process that the first number of detections is not smaller than the first threshold N1, the information indicative of abnormality is notified. Accordingly, the user is notified of abnormality due to the generation of the long-cycle abnormal discharge arising from the flaw of the photoconductor 51 or the like.

In the case where an instruction for instructing cleaning of the wire is notified in the notifying process, it is possible to encourage the user to clean the wire when the long-cycle abnormal discharge is generated. This configuration prevents the long-cycle abnormal discharge from being generated thereafter.

In the case where an instruction for instructing replacement of the photoconductor 51 is notified in the notifying process, it is possible to encourage the user to replace the photoconductor 51 when the long-cycle abnormal discharge is generated. This configuration prevents the long-cycle abnormal discharge from being generated thereafter.

In the case where the printing control is canceled in the notifying process, it is possible to prevent the photoconductor 51 from being deteriorated due to the long-cycle abnormal discharge.

In the case where the voltage applied to the charger 52 is decreased in the notifying process, it is possible to continue the printing control while preventing the long-cycle abnormal discharge from being generated.

It is noted that the present disclosure is not limited to the details of the illustrated embodiment, but may be embodied with various other changes and modifications as described below, for instance. In the following explanation, the same reference sings as used in the illustrated embodiment are used to identify substantially the same configurations and steps, and a detailed explanation thereof is dispensed with.

In the illustrated embodiment, the cyclic current counter $C_X$ is incremented even if the overcurrent detection signal for incrementing the cyclic current counter $C_X$ of the present position is not successively input to the controller 100. That is, in the illustrated embodiment, the cyclic current counter $C_X$ is incremented when the overcurrent detection signal for incrementing the cyclic current counter $C_X$ of the present position is intermittently input within a time up to when the photoconductor 51 has rotated five times. The present disclosure is not limited to this configuration. For instance, the cyclic current counter $C_X$ may be incremented only when the overcurrent detection signal for incrementing the cyclic current counter $C_X$ of the present position is successively input to the controller 100. In other words, the controller 100 may be configured to determine in the first counting process whether the first number of detections, as the number of detections successively counted in the first determination process, is not smaller than the first threshold N1 being not smaller than 2. In other words, the controller 100 may be configured to increment the cyclic current counter $C_X$ only when the controller 100 successively detects the overcurrent detection signal every first cycle T1 and the cyclic current counter $C_X$ is counted successively every first cycle T1.

Figure 7:
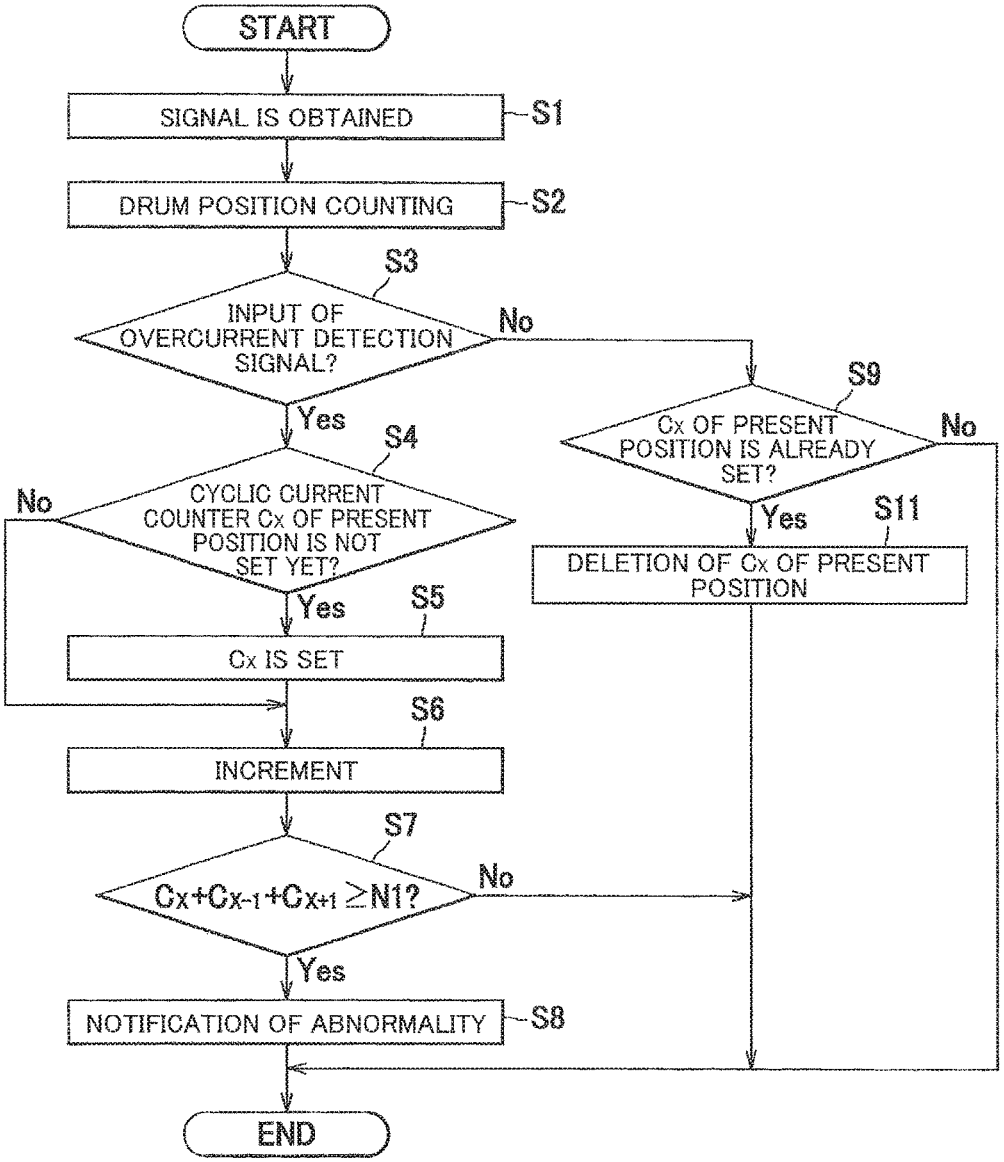
FIG. 7 is a flowchart showing a long-cycle abnormality determining process according to a first modification.

Specifically, the controller 100 may be configured to execute a process shown in FIG. 7, for instance. The process shown in FIG. 7 differs from the process shown in FIG. 4 that Step S10 of the process of FIG. 4 is deleted in the process of FIG. 7. According to this configuration, when it is determined at Step S3 that the overcurrent detection signal is not input (No) in a situation in which the cyclic current counter $C_X$ of the present position is already set at Step S5, the controller 100 makes an affirmative decision (Yes) at Step S9 and then deletes the cyclic current counter $C_X$ of the present position (S11).

That is, in the case where, among the signals input to the controller 100 every time the photoconductor 51 makes one rotation after the time point of setting the cyclic current counter $C_X$ at Step S5, the normal signal is input even only once, the controller 100 deletes the cyclic current counter $C_X$. In other words, only when the overcurrent detection signals for the specific portion of the photoconductor 51, for which the cyclic current counter $C_X$ is already set, are successively input to the controller 100, the controller 100 increments the cyclic current counter $C_X$ (e.g., from "1" to "2"). This configuration enables determination in the first determination process as to whether the abnormal discharge arising from the photoconductor 51 is being successively generated.

In the illustrated embodiment, the number of detections is reset by deleting the counter from the memory area. The present disclosure is not limited to this configuration. For instance, the number of detections may be reset by setting, to 0, the item of the number of counts of the counter stored in the memory area.

The timing of resetting the first number of detections is not limited to the particular timing described above. For instance, the controller 100 may be configured to execute an end determining process of determining whether the number of times that the counting of the first number of detections has not been performed is not smaller than a third threshold N3. When it is determined in the end determining process that the number of times that the counting of the first number of detections has not been performed is not smaller than the third threshold N3, the first number of detections may be reset. Here, the number of times that the counting of the first number of detections ($C_X$) has not been performed is incremented when the controller 100 determines that the overcurrent detection signal has not been input, at each of time points corresponding to every first cycle T1 after the time point when the controller has first detected the overcurrent detection signal (i.e., the time point when the controller has first counted the first number of detections). Further, the number of times that the counting of the first number of detections has not been performed may be the number of determinations that the overcurrent detection signal has not been input successively every first cycle after a time point of the last detection of the overcurrent detection signal. Moreover, the number of times that the counting of the first number of detections has not been performed may be the total number of times of determinations, calculated from the time point of the last detection of the overcurrent detection signal, that the overcurrent detection signal has not been input every first cycle.

Figure 8:
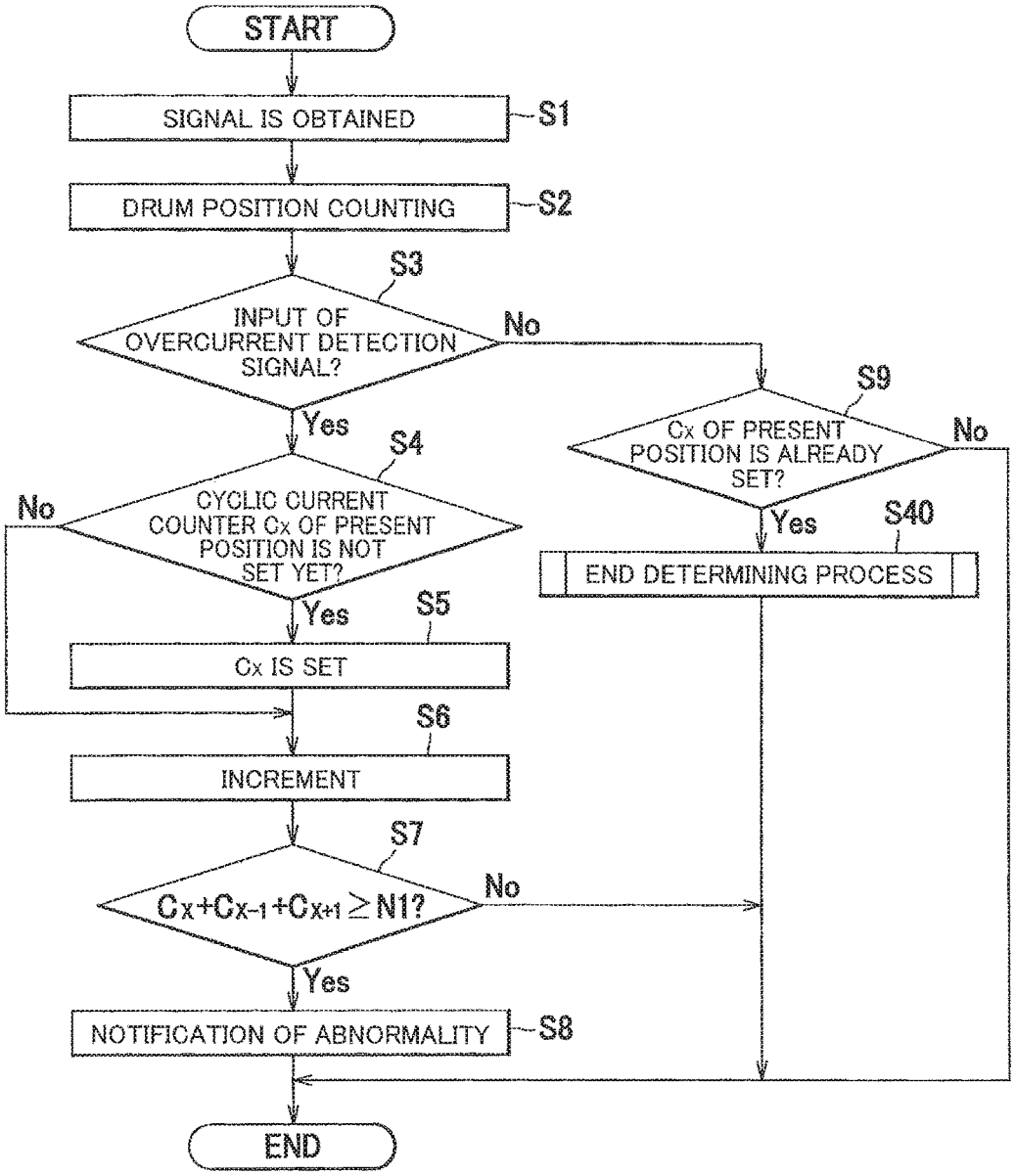
FIG. 8 is a flowchart showing a long-cycle abnormality determining process according to a second modification.
Figure 9:
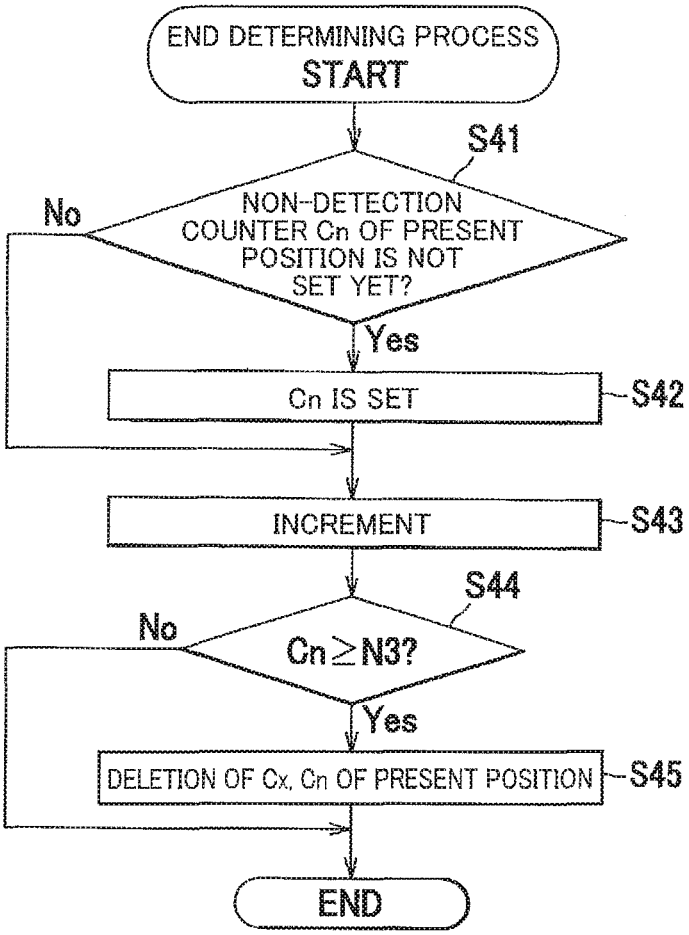
FIG. 9 is a flowchart showing an end determining process.

Specifically, the controller 100 may be configured to execute processes shown in FIGS. 8 and 9, for instance. The process shown in FIG. 8 includes Steps S1-S9 similar to those of the process of FIG. 4 and a new Step S40 in place of Steps S10, S11 of the process of FIG. 4.

As shown in FIG. 8, when the controller 100 determines at Step S9 that the cyclic current counter $C_X$ of the present position is already set (Yes), the controller 100 executes the end determining process (S40). As shown in FIG. 9, in the end determining process, the controller 100 determines whether a non-detection counter Cn of the present position is not set yet (S41). Here, the non-detection counter Cn is a counter for counting the number of times that the overcurrent detection signal has not been input. The non-detection counter Cn is set for each of respective positions on the surface of the photoconductor 51.

When it is determined at Step S41 that the non-detection counter Cn of the present position is not set yet (Yes), the controller 100 sets the non-detection counter Cn of the present position (S42). Specifically, in the case where the input signal with the number "0" assigned at Step S2 of FIG. 8 is the normal signal, the controller 100 sets the non-detection counter Cn0 corresponding to the number "0".

After Step S42 or when a negative decision (No) is made at Step S41, the controller 100 increments the non-detection counter Cn of the present position (S43). After Step S43, the controller 100 determines whether the non-detection counter Cn of the present position is not smaller than the third threshold N3 (S44).

When it is determined at Step S44 that the non-detection counter Cn is not smaller than N3 (Cn≥N3) (Yes), the controller 100 deletes the cyclic current counter $C_X$ and the non-detection counter Cn of the present position (S45) and ends the present process. On the other hand, when it is determined at Step S44 that the non-detection counter Cn is smaller than N3 (Cn<N3) (No), the controller 100 ends the process.

In the illustrated embodiment, the controller 100 determines the generation of the cyclic discharge such that the cyclic current counter $C_X$ is incremented every time the overcurrent detection signal is input. The present disclosure is not limited to this configuration. For instance, the controller may be configured to store, in the memory, the signal as needed every time the controller obtains the signal from the overcurrent detector in the obtaining process and to determine the cyclic discharge based on a relationship between the present overcurrent detection signal and the previous overcurrent detection signals.

In the illustrated embodiment, the charger 52 of scorotron type is employed. The present disclosure is not limited to this configuration. For instance, the charger may be of corotron type or may be a charging roller that contacts the photoconductor. Also in the case where the charger is a charging roller, the overcurrent may flow due to a flaw formed at a specific portion of the photoconductive layer or due to attachment of conductive foreign matters to the surface of the photoconductor, which may cause a deterioration of the photoconductor.

In the illustrated embodiment, the overcurrent detector 200 is a current detecting circuit connected to the high voltage power source 16 for applying the voltage to the wire 521. The present disclosure is not limited to this configuration. For instance, a circuit connected to the wire that is connected to the grid electrode may be used as the overcurrent detector. Further, the overcurrent detector may be a circuit connected to a high voltage power source configured to apply a voltage to a charging roller.

In the illustrated embodiment, the number of detections ($C_X+C_{X-1}+C_{X+1}$) of the cyclic abnormal discharge generated on the first cycle T1 including the range α, namely, the period T2±α, is compared with the first threshold N1. The present disclosure is not limited to this configuration. For instance, the number of detections $C_X$ of the cyclic abnormal discharge generated on the first cycle T1 not including the range α, namely, the period T2, may be compared with the first threshold N1.

In the embodiment, the photoconductor 51 is used as one example of the photoconductor. The present disclosure is not limited to this configuration. The photoconductor may be a photoconductor belt.

While the present disclosure is applied to the color printer 1 in the illustrated embodiment, the present disclosure may be applied to other image forming apparatuses such as a copying machine and a multi-function peripheral.

The elements explained in the illustrated embodiments and the modifications may be suitably combined.

What is claimed is:

1. An image forming apparatus, comprising:

a photoconductor configured to be rotatable;

a charger configured to charge the photoconductor;

an overcurrent detector configured to output an overcurrent detection signal in response to detection of an overcurrent in the charger; and a controller, wherein the controller is configured to execute:

an obtaining process of obtaining, in each of a plurality of obtaining periods, the overcurrent detection signal output from the overcurrent detector for each of a plurality of positions assigned in a circumferential direction of the photoconductor, each of the plurality of obtaining periods being a period of time in which a corresponding one of the plurality of positions is opposed to the charger;

a first counting process of counting a first number of detections based on the overcurrent detection signal obtained in the obtaining process, the first number of detections being the number of the overcurrent detection signals synchronized with a first cycle corresponding to one rotation of the photoconductor, each of the overcurrent detection signals being obtained in each of a plurality of specific obtaining periods, each of the plurality of specific obtaining periods being a period of time in which a specific position of the plurality of positions is opposed to the charger; and a first determining process of determining whether the first number of detections is not smaller than a first threshold which is not smaller than 2.

2. The image forming apparatus according to claim 1, wherein the controller is configured to execute:

a second counting process of counting a second number of detections based on the overcurrent detection signal obtained in the obtaining process, the second number of detections being the number of the overcurrent detection signals in a period shorter than the first cycle; and a second determining process of determining whether the second number of detections counted in the second counting process is not smaller than a second threshold which is not smaller than 2.

3. The image forming apparatus according to claim 1, wherein the controller is configured to:

count the first number of detections as the number of times that the overcurrent detection signal is successively counted every first cycle in the first counting process; and determine in the first determining process whether the first number of detections is not smaller than the first threshold.

4. The image forming apparatus according to claim 1, wherein, where the maximum number of rotations of the photoconductor in a period from a start timing of the first count process to an end timing of the first count process is represented as M, and the first threshold is represented as N1, the following expression is satisfied:

$$M>N1>M/2.$$

5. The image forming apparatus according to claim 1, wherein the controller is configured to execute an end determining process of determining whether the number of times of non-counting of the overcurrent detection signal synchronized with the first cycle is not smaller than a third threshold, and wherein the controller is configured to reset the first number of detections when it is determined in the end determining process that the number of times of non-counting of the overcurrent detection signal synchronized with the first cycle is not smaller than the third threshold.

6. The image forming apparatus according to claim 1, wherein the controller is configured to provide information indicating abnormality when it is determined in the first determining process that the first number of detections is not smaller than the first threshold.

7. The image forming apparatus according to claim 1, wherein the charger includes a wire configured to cause a corona discharge, and wherein the controller is configured to provide an instruction for instructing cleaning of the wire when it is determined in the first determining process that the first number of detections is not smaller than the first threshold.

8. The image forming apparatus according to claim 1, wherein the controller is configured to provide an instruction for instructing replacement of the photoconductor when it is determined in the first determining process that the first number of detections is not smaller than the first threshold.

9. The image forming apparatus according to claim 1, wherein the controller is configured to cancel a printing control when it is determined in the first determining process that the first number of detections is not smaller than the first threshold.

10. The image forming apparatus according to claim 1, wherein the controller is configured to decrease a voltage applied to the charger when it is determined in the first determining process that the first number of detections is not smaller than the first threshold.

11. A method of controlling an image forming apparatus including: a photoconductor configured to be rotatable; a charger configured to charge the photoconductor; and a detector configured to detect a current in the charger, comprising:

an obtaining step of obtaining, in each of a plurality of obtaining periods, an overcurrent detection signal, for each of a plurality of positions assigned in a circumferential direction of the photoconductor, each of the plurality of obtaining periods being a period of time in which a corresponding one of the plurality of positions is opposed to the charger, in response to a signal output from the detector;

a first counting step of counting a first number of detections based on the overcurrent detection signal obtained in the obtaining step, the first number of detections being the number of the overcurrent detection signals synchronized with a first cycle corresponding to one rotation of the photoconductor, each of the overcurrent detection signals being obtained in each of a plurality of specific obtaining periods, each of the plurality of specific obtaining periods being a period of time in which a specific position of the plurality of positions is opposed to the charger; and a first determining step of determining whether the first number of detections is not smaller than a first threshold which is not smaller than 2.

12. The method of controlling the image forming apparatus according to claim 11, further comprising:

a second counting step of counting a second number of detections based on the overcurrent detection signal obtained in the obtaining step, the second number of detections being the number of the overcurrent detection signals in a period shorter than the first cycle; and a second determining step of determining whether the second number of detections counted in the second counting step is not smaller than a second threshold which is not smaller than 2.

13. The method of controlling the image forming apparatus according to claim 11, wherein, in the first counting step, the first number of detections as the number of times that the overcurrent detection signal is successively counted every first cycle, and wherein, in the first determining step, it is determined whether the first number of detections is not smaller than the first threshold.

14. The method of controlling the image forming apparatus according to claim 11, wherein, where the maximum number of rotations of the photoconductor in a period from a start timing of the first counting step to an end timing of the first counting step is represented as M, and the first threshold is represented as NI, the following expression is satisfied:

$$M>N1>M/2.$$

15. The method of controlling the image forming apparatus according to claim 11, further comprising an end determining step of determining whether the number of times of non-counting of the overcurrent detection signal synchronized with the first cycle is not smaller than a third threshold, wherein the first number of detections is reset when it is determined in the end determining step that the number of times of non-counting of the overcurrent detection signal synchronized with the first cycle is not smaller than the third threshold.

16. The method of controlling the image forming apparatus according to claim 11, wherein information indicating abnormality is provided when it is determined in the first determining step that the first number of detections is not smaller than the first threshold.

17. The method of controlling the image forming apparatus according to claim 11, wherein the charger includes a wire configured to cause a corona discharge, and wherein an instruction for instructing cleaning of the wire is provided when it is determined in the first determining step that the first number of detections is not smaller than the first threshold.

18. The method of controlling the image forming apparatus according to claim 11, wherein an instruction for instructing replacement of the photoconductor is provided when it is determined in the first determining step that the first number of detections is not smaller than the first threshold.

19. The method of controlling the image forming apparatus according to claim 11, wherein a printing control is canceled when it is determined in the first determining step that the first number of detections is not smaller than the first threshold.

20. The method of controlling the image forming apparatus according to claim 11, wherein a voltage applied to the charger is decreased when it is determined in the first determining step that the first number of detections is not smaller than the first threshold.

* * * * *